US007114273B2

(12) United States Patent
Giovalle et al.

(10) Patent No.: US 7,114,273 B2
(45) Date of Patent: Oct. 3, 2006

(54) LAUNDRY IRON COMPRISING A WATER RESERVOIR PROVIDED WITH A FILLING HOLE AT THE REAR END OF THE IRON

(75) Inventors: Christian Giovalle, Moidieu Detourbe (FR); Michel Jouvel, Chaponost (FR)

(73) Assignee: SEB S.A., Ecully Cedex (FR)

( * ) Notice: Subject to any disclaimer, the term of this patent is extended or adjusted under 35 U.S.C. 154(b) by 0 days.

(21) Appl. No.: 10/538,852

(22) PCT Filed: Jun. 29, 2004

(86) PCT No.: PCT/FR2004/001659

§ 371 (c)(1),
(2), (4) Date: Jun. 14, 2005

(87) PCT Pub. No.: WO2005/014915

PCT Pub. Date: Feb. 17, 2005

(65) Prior Publication Data

US 2006/0086012 A1 Apr. 27, 2006

(30) Foreign Application Priority Data

Jul. 11, 2003 (FR) ..... 0308506

(51) Int. Cl.
*D06F 75/18* (2006.01)
*D06F 75/14* (2006.01)

(52) U.S. Cl. ..... 38/77.8

(58) Field of Classification Search ..... 38/77.82, 38/77.8, 77.7, 77.81, 77.5, 90, 75, 77.3
See application file for complete search history.

(56) References Cited

U.S. PATENT DOCUMENTS 2,387,281 A * 10/1945 Morton ..... 38/77.7
3,418,736 A * 12/1968 Kueser ..... 38/77.81
4,398,364 A * 8/1983 Augustine et al. ..... 38/77.5
4,594,801 A * 6/1986 Gronwick et al. ..... 38/90
5,063,697 A * 11/1991 Valente et al. ..... 38/75
5,170,577 A * 12/1992 Brandolini et al. ..... 38/77.8
5,307,573 A * 5/1994 Watkins ..... 38/77.8
5,398,434 A * 3/1995 Biancalani ..... 38/77.3
5,526,595 A * 6/1996 Daulasim et al. ..... 38/77.8
5,743,034 A * 4/1998 Debourg et al. ..... 38/77.8
5,926,983 A 7/1999 Tee et al.
2004/0050837 A1 3/2004 Bontems et al.
2004/0237357 A1 12/2004 Bontems et al.

FOREIGN PATENT DOCUMENTS

DE 10 16 226 B 9/1957
FR 2 830 266 A 4/2003

* cited by examiner

*Primary Examiner*—Ismael Izaguirre
(74) *Attorney, Agent, or Firm*—Browdy and Neimark, PLLC

(57) ABSTRACT

The invention relates to a laundry iron comprising a water reservoir (3) provided with a filling hole (5) situated at the rear end of the iron so that the reservoir (3) is filled while holding the iron tipped forward. Said reservoir (3) communicates with a drop-by-drop body (7) that supplies a vaporization chamber (10). The invention is characterized in that the drop-by-drop body (7) is supplied by a channel (8) that open near the rear of the reservoir (3).

9 Claims, 3 Drawing Sheets

LAUNDRY IRON COMPRISING A WATER RESERVOIR PROVIDED WITH A FILLING HOLE AT THE REAR END OF THE IRON

The present invention relates to a pressing iron and more particularly to a pressing iron having a water reservoir provided with a filling opening on the rear face of the iron.

There is known from patent application FR 2 830 266, filed by the applicant, a pressing iron having an opening for filling the reservoir placed at the level of the heel of the iron and oriented in a manner such that the filling of the reservoir is carried out by holding the pressing iron substantially vertically, the tip toward the bottom. Such an arrangement makes it possible to have a filling opening of significant size, free of any obstacle, which facilitates rapid filling of the reservoir, by placing it in particular directly under a tap. However, such a pressing iron usually has a steam chamber supplied with a drip device plug that is disposed at the front of the iron for reasons of obstruction.

However, such an arrangement of the drip device plug at the front of the iron presents the disadvantage of making it possible for the water to flow out of the reservoir through the drip device plug when the iron is rocked forwards. It follows that, during the operation of filling of the reservoir, water can flow out of the iron if the user did not think to close the plug, which is objectionable to the user.

Therefore, a goal of the present invention is to remedy this disadvantage by offering a pressing iron provided with a reservoir with filling at the rear not allowing water to escape from the reservoir when the iron is placed with its head toward the bottom and in which the flow of water from the reservoir toward the steam chamber is effectuated correctly when the iron is placed on its soleplate.

To this end, the invention has as an object a pressing iron having a water reservoir provided with a filling opening located on the rear face of the iron so that filling of the reservoir is carried out by holding the iron rocked forwards, the reservoir being in communication with a drip device plug feeding a steam chamber, characterized in that the drip device plug is fed by a canalization opening near the back of the reservoir.

Such a characteristic makes it possible to prevent water in the reservoir from flowing through the valve when iron is rocked forwards, in particular during filling of the reservoir.

According to a particular embodiment of the invention, the canalization opens in the lower rear part of the reservoir.

Such a characteristic makes it possible to optimize supplying the valve when iron is posed on its soleplate.

According to another characteristic of the invention, the filling opening of the reservoir is extended inside the reservoir by a sleeve providing in the reservoir, outside the sleeve, a reserve of air during the filling of the reservoir.

Such a characteristic has the advantage of providing a reserve of air that is difficult to fill with water during the filling of the reservoir.

According to another characteristic of the invention, the canalization opens in the reserve of air provided at both sides of the sleeve.

Such a characteristic makes it possible to further limit the risks of flow of water through the drip device plug during filling of the reservoir.

According to still another characteristic of the invention, the reservoir has a wall extending from the bottom of the reservoir and forming a barrier retaining water on the back of the reservoir when the water level in the latter becomes low.

Such a characteristic aids complete emptying of the reservoir through the canalization supplying the valve while retaining, on the back of the reservoir, water coming from waves generated by the front to back movements during ironing. Such a characteristic in particular makes it possible to use a reservoir of which the back part is elevated with respect to the front part, while preserving a good emptying of the reservoir.

According to another characteristic of the invention, the canalization is constituted by a supply tube and the wall forming the barrier extends transversely across the width of the reservoir and vertically over a height corresponding substantially to the external diameter of the supply tube, this wall having an opening for the passage of the supply tube.

According to still another characteristic of the invention, the reservoir has a vent circuit presenting an end opening at the rear part of the reservoir and an end, in contact with the surrounding air, located in the upper front part of the iron.

Such a characteristic makes it possible to vent the reservoir allowing a good flow of water in the direction of the drip device plug and limiting the risks of flow of water out of the reservoir when iron is rocked forwards or is placed on its heel.

According to still another characteristic of the invention, the vent circuit has a buffer chamber placed in the upper front part of the body of the iron in order to be above the maximum water level in the reservoir when the iron rests horizontally.

Such a characteristic makes it possible to prevent water from escaping through the end of the vent circuit while collecting, in the buffer chamber, water present in the vent circuit when the iron is rocked forwards.

According to still another characteristic of the invention, the vent circuit comprises a pipe of small cross section that opens into the upper rear part of the reservoir and is prolonged by a bell extending toward the bottom and presenting an opening in its lower part.

Such a characteristic makes it possible to limit the volume of the buffer chamber while ensuring a good operation of the vent circuit.

One will better understand the goals, aspects and advantages of this invention, according to the description given hereafter of a particular embodiment of the invention presented as a nonlimiting example, while referring to the annexed drawings in which.

Figure 1:
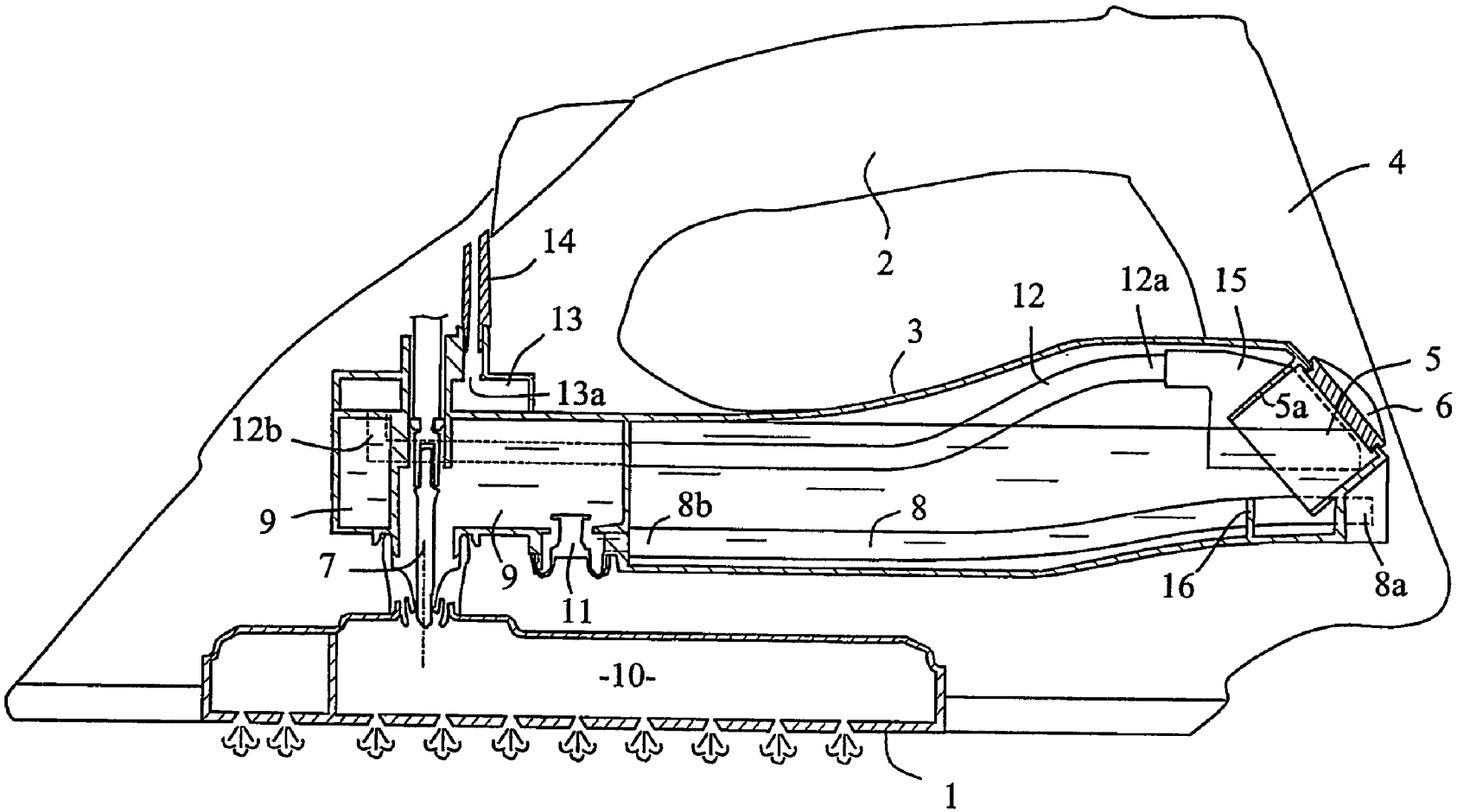
FIG. 1 is a general view, in longitudinal cross section, of a pressing iron according to a particular embodiment of the invention.
Figure 2:
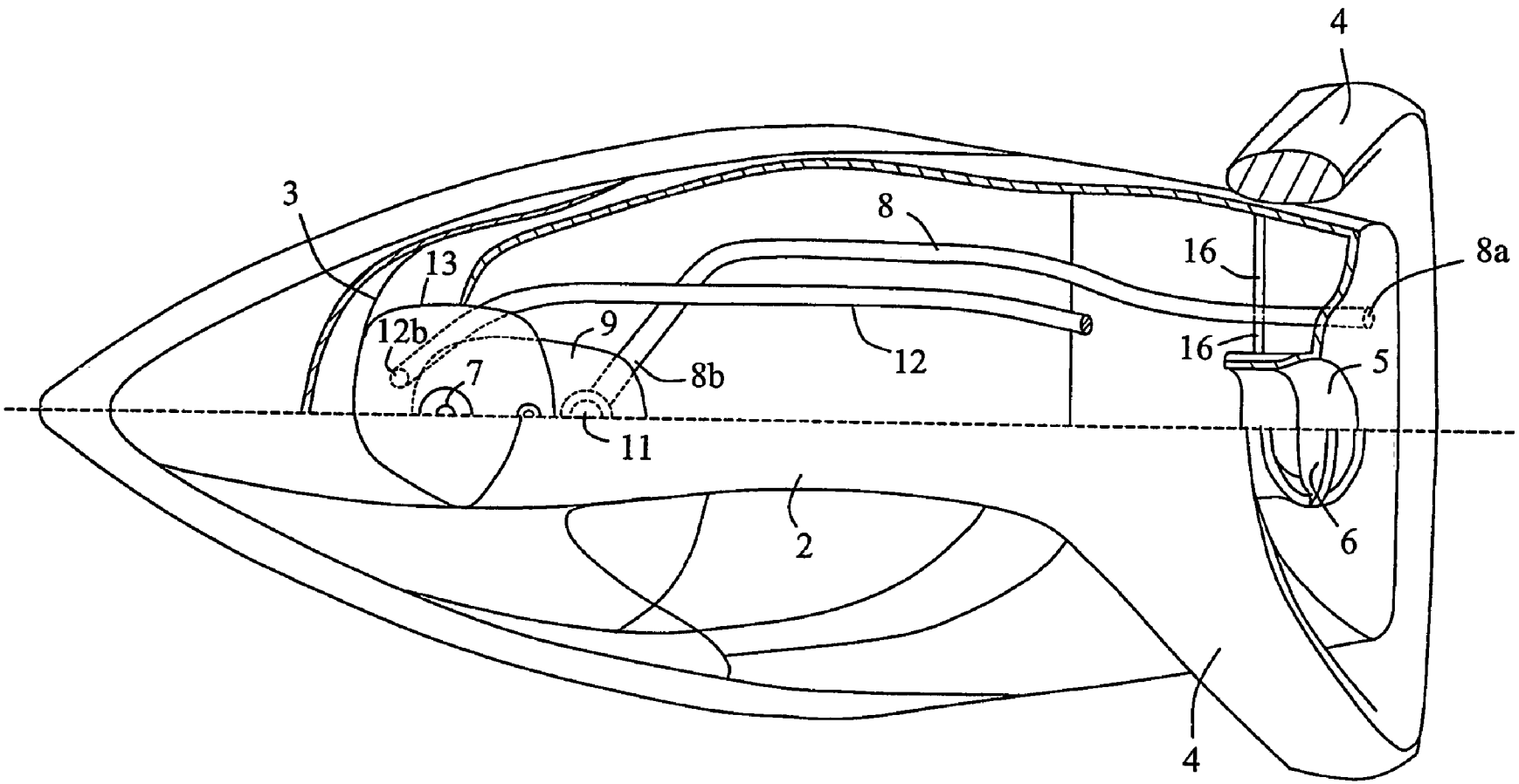
FIG. 2 is a top view of the pressing iron of FIG. 1 in which the upper half-view is represented partially broken away.

FIGS. 1 and 2 represent a diagrammatic view of a steam pressing iron having a heating soleplate 1, a handle 2 and a body integrating a water reservoir 3. Handle 2 is connected to the rear of the iron by two arms 4 extending, while diverging from handle 1, to the body of the iron so that the structure obtained is substantially triangulated and constitutes a heel on which the iron can rest.

Figure 3:
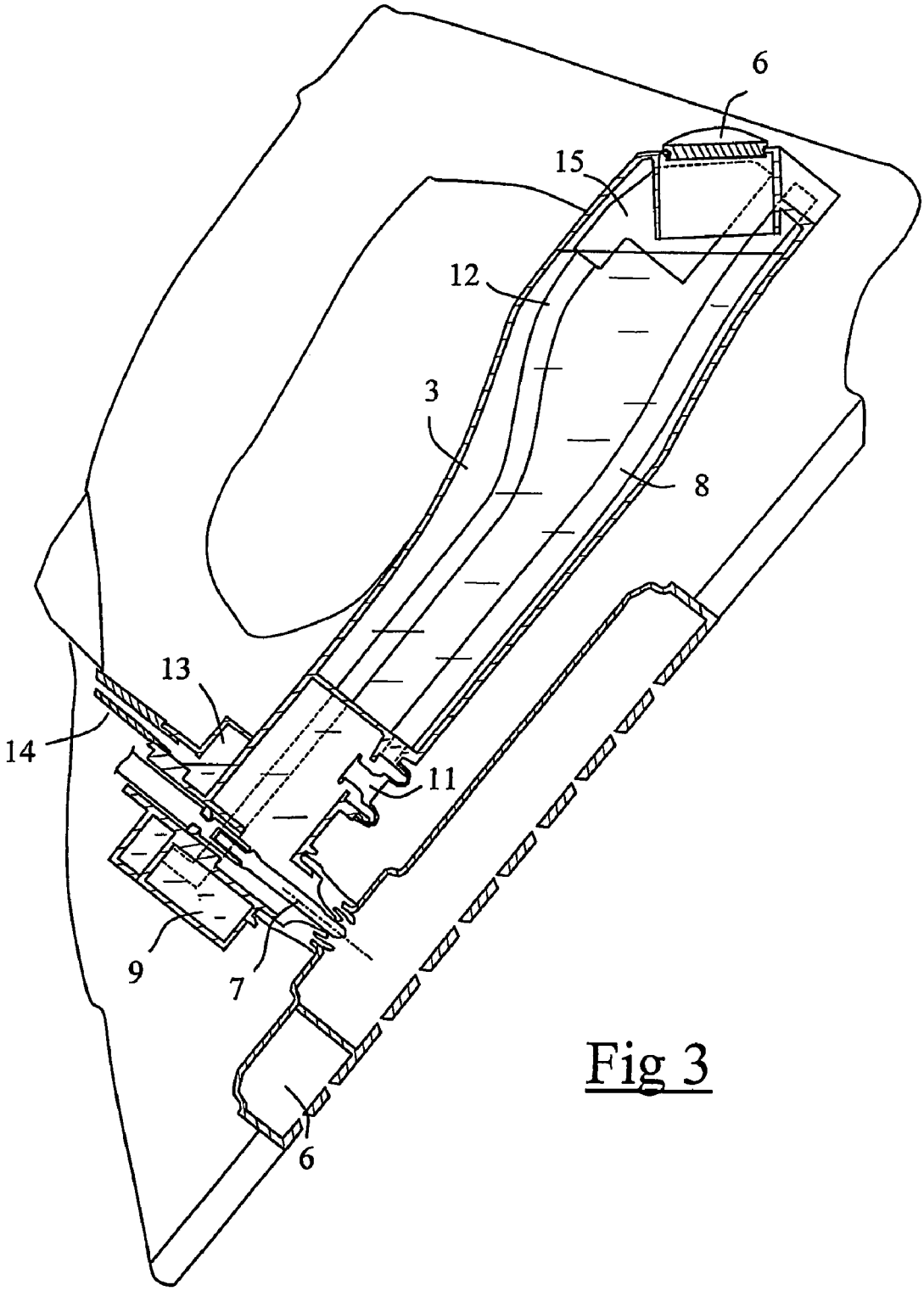
FIG. 3 is a view similar to FIG. 1, representing the iron in position rocked forwards, adapted for filling of the reservoir.

In accordance with FIG. 1, reservoir 3 of the iron comprises a filling opening 5 disposed on the rear face of the iron, between the two arms 4. Opening 5 is inclined towards the rear of the iron so that the filling of the iron is carried out by holding the iron rocked forward, as represented in FIG. 3. For reasons of obstruction under reservoir 3, the latter presents a back part that is raised relative to the front part of reservoir 3.

Filling opening 5 is blocked by a removable stopper 6 and has a cylindrical sleeve 5*a*, in the axis of opening 5, extending over a few centimeters towards the interior of reservoir 3. The lower end of sleeve 5*a* delimits the maximum level of filling of reservoir 3 when the iron is in the filling position, rocked forwards. Moreover, in this filling position, sleeve 5*a* provides in reservoir 3, on both sides of the sleeve 5*a*, a volume that is difficult to fill with water, constituting a reserve of air.

More particularly according to the invention, reservoir 3 is connected, by the intermediary of a supply tube 8, to a chamber 9 integrated in the front part of reservoir 3 and feeding a drip device plug 7 delivering water gradually into a steam chamber 10 integrated in heating soleplate 1.

The supply tube 8, which extends at the bottom of reservoir 3, preferably presents an internal diameter greater than 5 mm and has an end 8*a* opening freely at the rear of reservoir 3, in volume surrounding sleeve 5*a*. The other end 8*b* of the supply tube is connected to a drip preventing valve 11 interposed between reservoir 3 and chamber 9 for supplying drip device plug 7. In a known way, drip preventing valve 11 is controlled by a control unit, not represented, ensuring the closing of the valve when the temperature of the steam chamber is not sufficient for the production of steam.

In order to aid the filling of supply pipe 8 when the water level in reservoir 3 becomes low, a wall 16 is disposed at the rear of the reservoir. This wall 16 extends transversely to reservoir 3 over all the width of the latter. Wall 16 extends vertically, starting from the bottom of reservoir 3, to a height corresponding substantially to the outer diameter of tube 8 and has a notch into which supply tube 8 is inserted so that the connection between these two elements is waterproof. This wall 16, which is advantageously molded with reservoir 3, plays the role of a barrier collecting water coming from waves generated by front to back displacement of the iron during the ironing phases and maintaining it around end 8*a*. Such a barrier has the advantage of ensuring the good emptying of the reservoir although end 8*a* opens into the slightly elevated reservoir rear part of reservoir 3.

In accordance with FIG. 1, reservoir 3 is also provided with a vent circuit permitting water from the reservoir to flow without difficulty into supply tube 8. This vent circuit has a vent pipe 12 of small passage cross section extending into reservoir 3 and comprising a rear end 12*a* advantageously connected to a hollow element 15 in the shape of a bell, not represented in FIG. 2, placed as far to the rear as possible in reservoir 3. Bell 15 plays the role of a pump eliminating, by aspiration, possible water drops attached by capillarity inside vent pipe 12 when the iron is rocked from the vertical position, on its heel, to the horizontal position on its sole.

The vent pipe also has a front end 12*b* connected to a buffer chamber 13 placed above reservoir 3, at the front end of the latter. Buffer chamber 13 has a volume substantially equal to the volume of water that can be contained in vent pipe 12 and has an upper wall provided with an opening 13*a* communicating with the surrounding air by the intermediary of a nozzle 14.

The pressing iron thus achieved has the advantage of allowing the filling of the reservoir, by holding the iron rocked forwards, without risk of flow of water out of the reservoir.

In accordance with FIG. 3 which represents iron in a position adapted for the filling of the reservoir, supply tube 8 makes it possible, in this position, to prevent the reservoir from being emptied through drip device plug 7 when the latter remains in a position provided for the production of steam. In effect, the end of supply tube 8 opens at the rear of reservoir 3 in an air pocket provided by the presence of sleeve 5*a*. Thus, only the small quantity of water present in supply tube 8 and supply chamber 9 can flow toward steam chamber 10 when the iron is rocked forward, this small quantity of water having every possibility of being evaporated in contact with steam chamber 10.

Buffer chamber 13 makes it possible, as for it, to prevent water from escaping through nozzle 14 of the vent circuit by collecting water possibly present in the vent circuit when the iron is rocked forward.

Of course, the invention is by no means limited to the embodiment described and illustrated which was given only by way of example. Modifications remain possible, in particular from the point of view of the constitution of the various elements or by substitution of technical equivalents, without departing as a result from the field protection of the invention.

The invention claimed is:

1. Pressing iron having a water reservoir (3) provided with a filling opening (5) located on the rear face of the iron so that filling of the reservoir (3) is carried out by holding the iron rocked forward, said reservoir (3) being in communication with a drip device plug (7) disposed in the front part of the iron and feeding a steam chamber (10), characterized in that said drip device plug (7) is fed by a canalization (8) opening near the rear of the reservoir (3).

2. Pressing iron according to claim 1, characterized in that said canalization (8) opens into the lower rear part of the reservoir (3).

3. Pressing iron according to claim 1, characterized in that the filling opening (5) of the reservoir (3) is prolonged to the interior of the reservoir by a sleeve (5*a*) providing in the reservoir (3), outside the sleeve (5*a*), a reserve of air during filling of the reservoir.

4. Pressing iron according to claim 3, characterized in that the canalization (8) opens into the reserve of air provided at both sides of the sleeve (5*a*).

5. Pressing iron according to claim 1, characterized in that the reservoir (3) comprises a wall (16) extending from the bottom of the reservoir (3) and forming a barrier retaining water on the rear of the reservoir (3) when the water level in the latter becomes low.

6. Pressing iron according to claim 5, characterized in that the canalization is constituted by a supply tube (8) and in that the wall (16) extends transversely across the width of the reservoir (3) and vertically over a height corresponding substantially to the external diameter of the supply tube (8), said wall (16) having an opening for the passage of the supply tube (8).

7. Pressing iron according to claim 1, characterized in that the reservoir (3) has a vent circuit presenting an end opening into the rear part of the reservoir (3) and an end, in contact with the surrounding air, located in the upper front part of the iron.

8. Pressing iron according to claim 7, characterized in that said vent circuit has a buffer chamber (13) placed in the upper front part of the body of the iron in order to be above the maximum water level in the reservoir (3) when the iron rests horizontally.

9. Pressing iron according to claim 7, characterized in that the vent circuit comprises a pipe (12) of small cross section that opens into the upper rear part of the reservoir (3) and is prolonged by a bell (15) extending downwardly and presenting an opening in its lower part.

* * * * *